US008745948B2

(12) United States Patent
Ban

(10) Patent No.: US 8,745,948 B2
(45) Date of Patent: Jun. 10, 2014

(54) ASSEMBLY FOR WALL COVERING

(71) Applicant: Hermes Sellier, Paris (FR)

(72) Inventor: Shigeru Ban, Tokyo (JP)

(73) Assignee: Hermes Sellier, Paris (FR)

( * ) Notice: Subject to any disclaimer, the term of this patent is extended or adjusted under 35 U.S.C. 154(b) by 0 days.

(21) Appl. No.: 13/780,432

(22) Filed: Feb. 28, 2013

(65) Prior Publication Data

US 2013/0232903 A1 Sep. 12, 2013

(30) Foreign Application Priority Data

Mar. 9, 2012 (FR) ..... 12 52165

(51) Int. Cl.

| | |
|---|---|
| ***E04H 1/00*** | (2006.01) |
| ***E04F 13/00*** | (2006.01) |
| ***E04F 13/08*** | (2006.01) |
| ***E04B 2/00*** | (2006.01) |
| ***A47F 5/08*** | (2006.01) |

(52) U.S. Cl.

USPC ..... 52/506.08; 52/235; 52/311.1; 52/385; 211/87.01

(58) Field of Classification Search

USPC ..... 52/36.4, 36.5, 235, 384, 385, 390, 391, 52/311.1, 506.01, 506.05, 506.06, 506.08, 52/747.1, DIG. 2; 211/87.01

See application file for complete search history.

(56) References Cited

U.S. PATENT DOCUMENTS

| | | | | |
|---|---|---|---|---|
| 1,437,114 | A * | 11/1922 | Maze | 52/282.1 |
| 3,005,293 | A * | 10/1961 | Hunter | 52/385 |
| 4,450,655 | A * | 5/1984 | Rosenthal et al. | 52/36.4 |
| 4,987,712 | A * | 1/1991 | Mancuso | 52/387 |
| 5,412,912 | A * | 5/1995 | Alves | 52/36.5 |
| 6,408,585 | B1 * | 6/2002 | Tajima | 52/506.06 |
| 6,837,384 | B2 * | 1/2005 | Secondino | 211/87.01 |
| 6,945,414 | B1 * | 9/2005 | Stevens et al. | 211/94.01 |
| 7,104,023 | B1 * | 9/2006 | Holztrager | 52/705 |
| 8,122,683 | B1 * | 2/2012 | Schwalenberg | 52/747.1 |
| 2010/0028592 | A1 * | 2/2010 | Barkdoll et al. | 428/99 |
| 2011/0173909 | A1 * | 7/2011 | Viau et al. | 52/302.1 |
| 2012/0247044 | A1 * | 10/2012 | Barkdoll et al. | 52/311.1 |

FOREIGN PATENT DOCUMENTS

WO 89 02502 A1 3/1989

OTHER PUBLICATIONS

French Search Report, dated Dec. 6, 2012, from corresponding French application.

* cited by examiner

*Primary Examiner* — Ryan Kwiecinski
(74) *Attorney, Agent, or Firm* — Young & Thompson

(57) ABSTRACT

An assembly for wall covering, includes a fastening structure provided with a body, an anchoring face, recesses having an insertion portion, two facing parallel upper reception portions, two facing parallel lower reception portions, and two support blocks, each block bordered in part by one of the upper and lower edges of the insertion portion and by the upper and lower reception portions. A fastening interface is configured to be attached to a covering element and to be mounted on the structure, which interface includes three branches, two of these branches projecting from a first branch configured to be inserted into the insertion portion then slid against a face of the body along a block and with the other branches being configured to be received in the upper or lower portions.

16 Claims, 7 Drawing Sheets

ASSEMBLY FOR WALL COVERING

FIELD OF THE INVENTION

The invention concerns the general field of the fastening of decorative elements and in particular wall covering, notably for example for interiors.

More particularly the invention concerns an assembly for wall covering, notably for example for home interiors.

It is known to directly and at least partially cover the interior walls of homes with a covering, for example of leather.

BACKGROUND OF THE INVENTION

It is also known to directly and permanently fasten, to interior walls of homes, large support plates covered in advance with a cover, for example of leather. These support plates are fastened to the walls in the manner of plaster boards.

These known solutions are satisfactory in terms of the covering of home interior walls by an interior covering but demounting, in other words the removal of that interior covering, proves difficult, or even impossible, without destroying the covering itself.

SUMMARY OF THE INVENTION

The invention aims to provide an assembly for wall covering that is simpler, more convenient and more economical both for putting a covering in place, in particular for a home interior, and for its removal.

According to a first aspect, the invention thus relates to an assembly for wall covering, characterized in that it comprises a fastening structure and at least one fastening interface configured to be joined to at least one covering element and to be mounted on said fastening structure, said at least one fastening structure being provided with a body, with at least one anchoring face and with at least one recess formed in said body and opening onto said anchoring face, which at least one recess comprises an insertion portion extending in a predetermined direction and provided with a first end, with a second end which is an opposite end to said first end, with an upper edge and with a lower edge which is an opposite edge to said upper edge, each of said upper and lower edges meeting said first and second ends, two upper reception portions extending from said upper edge and facing and being parallel to each other and two lower reception portions extending from said lower edge and facing and being parallel to each other; said fastening structure being furthermore provided with at least two support blocks formed in said body and each bordered at least partly by one of said upper and lower edges and by the two said upper or lower reception portions; said at least one fastening interface being provided with a first branch, with a second branch and with a third branch, said second and third branches projecting from said first branch and facing and being parallel to each other; said first branch being configured to be inserted into said insertion portion then slid against an opposite face of said body to said anchoring face, along a said support block; said second and third branches being configured to be received at least partially in the two said upper or lower reception portions.

The assembly according to the invention provides covering modularity that is particularly advantageous since that modularity enables simplicity and convenience both for putting in place and for removal of covering elements while preserving both the structural and aesthetic integrity of those covering elements.

By virtue of the assembly according to the invention, the covering elements may be assimilated with covering modules that are particularly simple and convenient both to put in place on the assembly and to remove.

Furthermore, this modularity is characterized by covering elements of various shapes, sizes, and structures which may be mounted in said assembly to produce a wall covering, in particular of a home interior.

It will be noted that the assembly according to the invention enables the mounting of covering elements outside the fastening structure provided those covering elements are mounted on that structure via one or more fastening interfaces. In other words, the covering elements may be mounted on the fastening structure so as to cover that structure at least partially, or even to extend beyond it.

It will furthermore be noted that the fastening structure may be configured geometrically so as to be substantially planar, or even dihedral, to be fastened on a home interior wall or to be carried by at least one carrier member disposed for example on the floor.

The assembly according to the invention is furthermore particularly convenient since the recesses formed in the fastening structure which are associated with the fastening interfaces configured in the manner indicated above enable the mounting of covering elements equally well on the wall, on the floor and on the ceiling.

The assembly according to the invention is furthermore particularly convenient in that it has no mounting orientation by virtue of the shape of the recesses. To be precise, the covering elements may be mounted on that fastening structure whatever its disposition.

According to other preferred particularly simple, convenient and economical features of the assembly according to the invention:

- at least two of said upper and lower reception portions are provided projecting from said upper edge, and respectively lower edge, at the location of one of said first and second ends of said insertion portion;
- the two said upper reception portions each extend facing one of the two said lower reception portions;
- said upper and lower reception portions extend from said insertion portion in a direction substantially orthogonal to said predetermined direction in which said insertion portion extends;
- said at least one recess is substantially H-shaped;
- said fastening structure has a plurality of said recesses nesting with each other and formed over a major part of said fastening structure;
- said insertion portion has a first predetermined length, said at least two support blocks each have a second predetermined length as well as a first predetermined thickness, said first branch has a third predetermined length comprised between said first and second predetermined lengths; and said second and third branches have a fourth predetermined length greater than or equal to said first predetermined thickness;
- said at least one fastening interface has a fourth branch meeting said second and third branches and facing said first branch, so as to be ring-shaped.
- said at least one fastening interface has at least one through-hole formed through said first branch and one of said second and third branches, which hole is configured to receive a first device for attaching said fastening interface to a said covering element;

said fastening structure is provided with at least one through-aperture distinct from said at least one recess and configured to receive a second device for attaching said fastening structure to a wall;

the assembly comprises a plug for obturating said through-aperture of said fastening structure for attaching it to a said wall, which obturating plug is configured to be mounted flush with said anchoring face.

said fastening structure and said at least one fastening interface are formed from rigid and/or semi-rigid material;

said fastening structure is of metal and said at least one fastening interface is of plastics material; and/or said fastening structure is provided with a plurality of panels assembled to each other and with a plurality of said fastening interfaces mounted on each of said panels.

According to a second aspect, the present invention also relates to a kit comprising an assembly and a plurality of covering elements configured to be mounted on said assembly.

The kit according to the invention is particularly simple, convenient and economical on account of the modularity it gives in the arrangement of the covering elements on that assembly and in particular on the fastening structure and in the putting in place of the covering elements in a home.

BRIEF DESCRIPTION OF THE DRAWINGS

The disclosure of the invention will now be continued with the description of an example embodiment, given below by way of illustrative and non-limiting example, with reference to the accompanying drawings, in which.

DETAILED DESCRIPTION OF THE INVENTION

Figure 1:
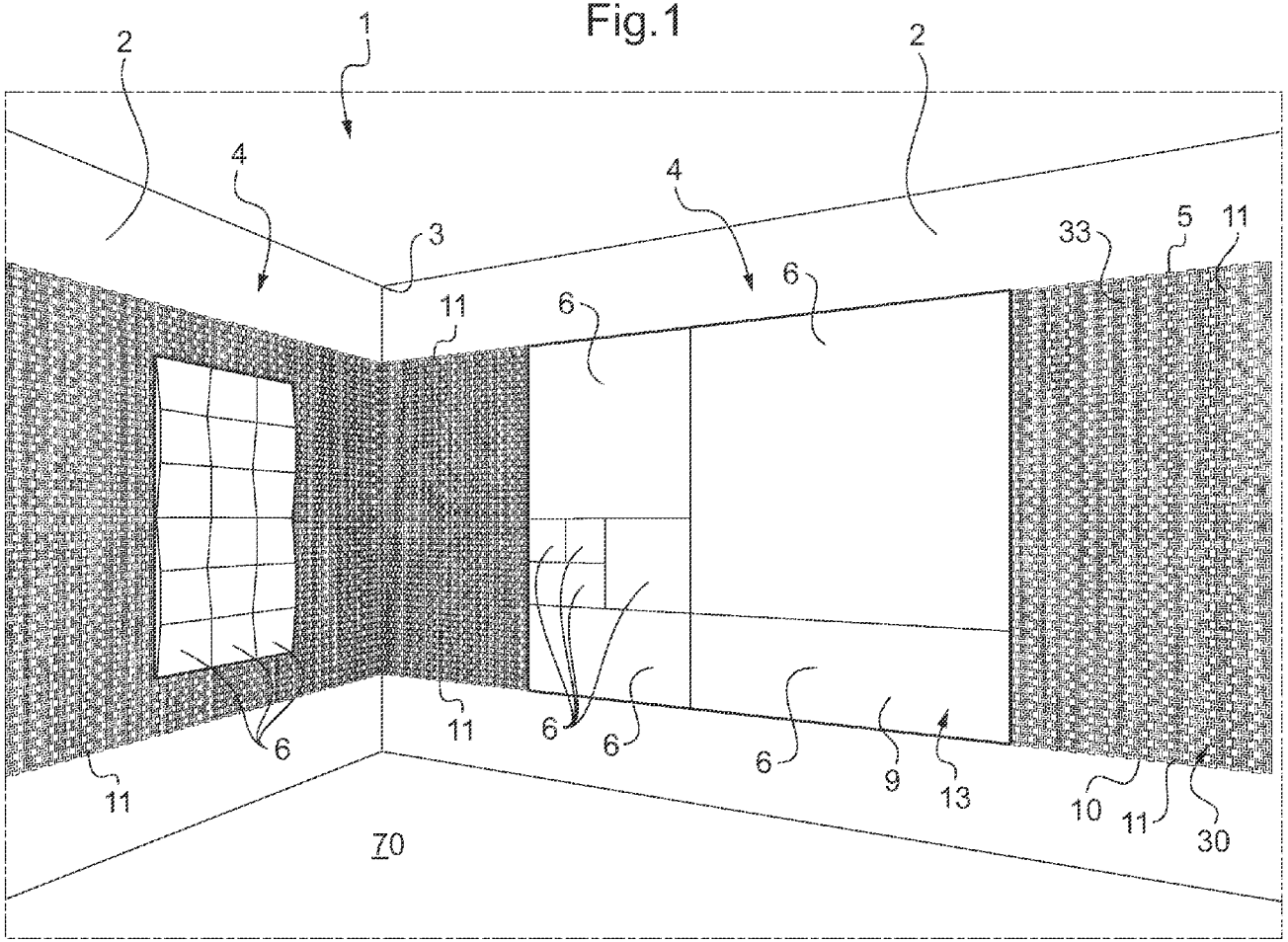
FIG. 1 is a partial diagrammatic illustration in perspective of two interior walls of a room of a home on which is fastened an assembly for wall covering in accordance with the invention, on which assembly are mounted a plurality of covering elements.

FIG. 1 is a partial diagrammatic illustration of a room 1 of a home provided with two walls 2 joined to each other at a corner 3, each of the walls 2 being joined furthermore to a floor 70 of that room 1.

These are interior walls 2 here, each of the walls 2 being partially covered by an interior covering 4.

This interior covering 4 is formed by a kit provided with an assembly 5 for interior covering and with a plurality of interior covering modules 6, each of the modules 6, also called covering elements, being attached to the assembly 5.

The modules 6 will now be described in more detail.

The modules 6 have different shapes, different sizes and may have various aspects, for example they may be flat or in relief, that is to say of 3D type.

These modules 6 are each formed from a solid metal frame 7, which is for example parallelepiped.

Each module 6 has a back face 12 and a front face 13 which is an opposite face to the back face 12.

The front face 13 of each module 6 is totally covered with foam (not shown), which is itself totally covered with a covering 9 formed from covering material.

This covering material is for example formed of leather, or even a textile.

The covering 9 extends beyond the front face 13 to come partially onto the periphery of the back face 12 to be fastened there.

As for that back face 12 it is covered by a metal sheet 8 formed from aluminum in order to mask the cut out edges of covering 9 located on that back face 12.

Each module 6 is furthermore provided with a plurality of apertures 14 formed in the frame 7 and opening through the back face 12.

Figure 2:
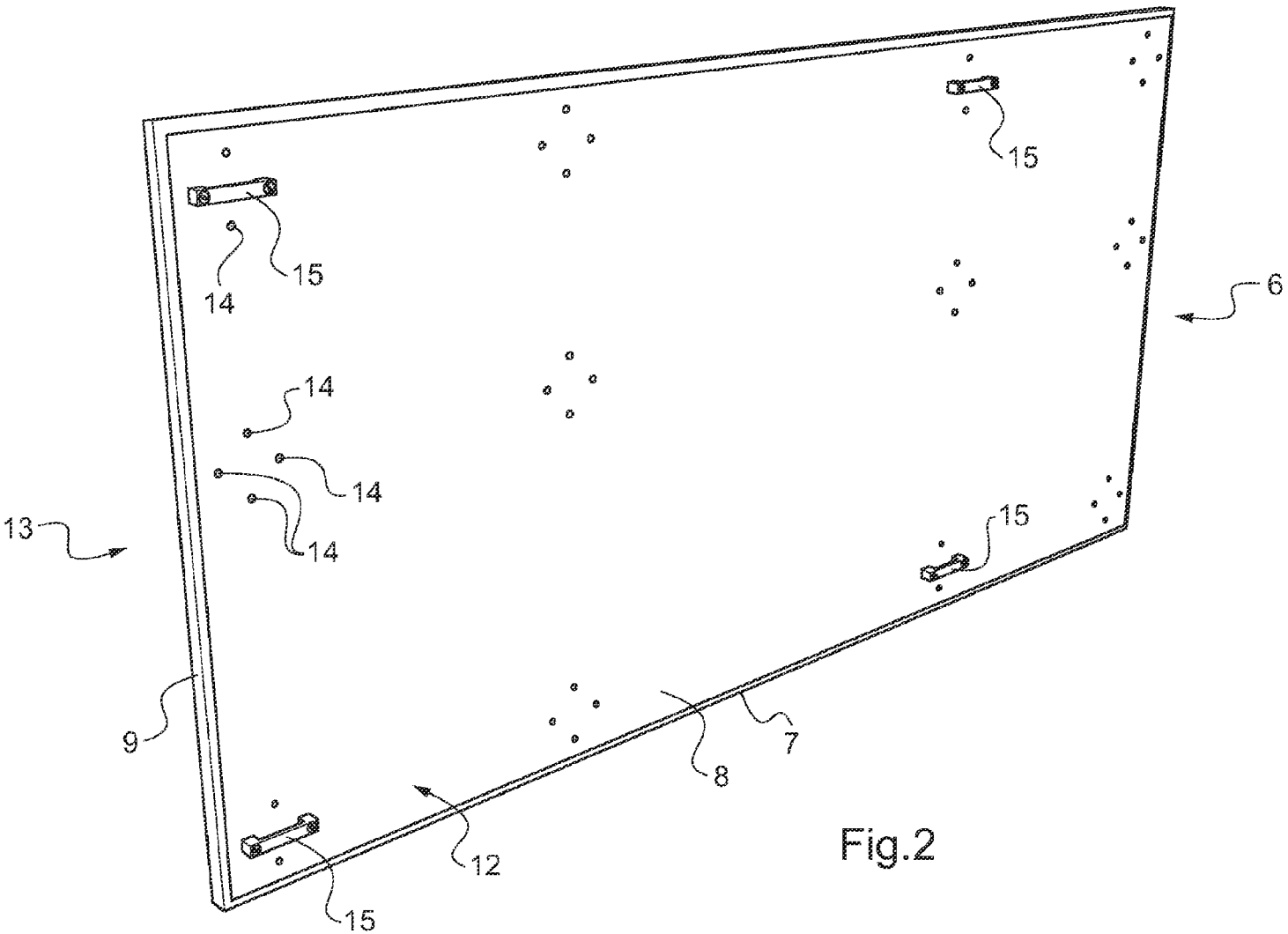
FIG. 2 shows one of the covering elements visible in FIG. 1, seen in perspective from the back, on which are fastened several fastening interfaces of the assembly illustrated in FIG. 1.
Figure 3:
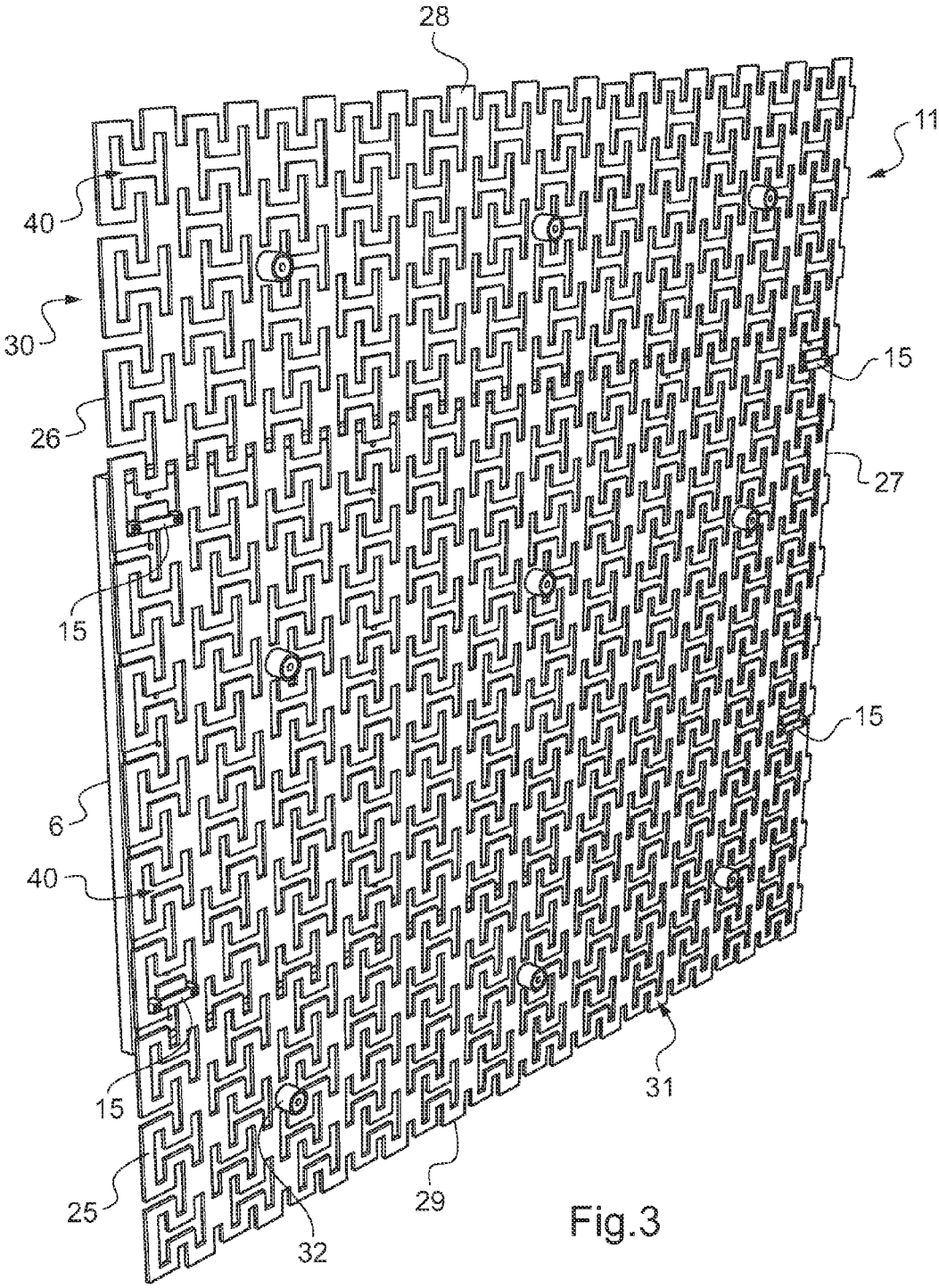
FIG. 3 is a perspective view from the back which partially shows the assembly illustrated in FIG. 1 and in particular a fastening structure of that assembly on which is attached the covering element of FIG. 2.

Here, the module 6 illustrated in FIG. 2 is provided with forty-eight apertures 14 and in particular with twelve groups of four apertures 14.

The four apertures 14 of each group are disposed so as to form a square.

This makes it possible to provide two distinct mounting positions for the module 6 on the fastening structure 10, as will be described below.

The assembly 5 will now be described in more detail for interior covering.

The assembly 5 for interior covering comprises a fastening structure 10 formed in FIG. 1 by a plurality of fastening panels 11.

The structure 10 here has a plurality of fastening panels 11 similar to a first type, i.e. they are rectangular and flat, as well as several dihedral fastening panels 11 similar to a second type, i.e. they are dihedral panels, these latter being disposed at the location of the corner 3 of the room 1 at the junction of two walls 2.

Of course, the fastening panels 11 may have sizes and shapes different from those illustrated in FIG. 1.

The assembly 5 further comprises a plurality of fastening interfaces 15, each being configured to be attached to a module 6, on its back face 12, and furthermore to be mounted on the fastening structure 10, in particular on a fastening panel 11.

The fastening interfaces 15 will now be described in more detail.

Each fastening interface 15 is formed from plastics material.

Each fastening interface 15 is provided with a longitudinal branch 16, also called first branch, and with two transverse branches 17 and 18, also called second and third branches, which transverse branches 17 and 18 project orthogonally from the longitudinal branch 16, at the ends thereof.

The longitudinal branch 16 has an interior bearing face 21 and an exterior bearing face 22 which is an opposite face to the interior bearing face 21.

The transverse branches 17 and 18 each have a free end 19, 20 by which the fastening interface 15 is configured to come to bear against the back face 12 of the module 6.

The fastening interface 15 further comprises two through-holes 23 opening on both sides of that fastening interface 15.

Each through-hole 23 opens on the outside face 22 of the longitudinal branch 16 and at the location respectively of the free end 19 of the transverse branch 17, and respectively of the free end 20 of the transverse branch 18.

Each of these through-holes 23 is configured to receive a first device for attaching that fastening interface 15 to the module 6.

The attaching device is for example a metal screw 24.

A fastening panel 11 of the fastening structure 10 will now be described in more detail.

Each fastening panel 11 is provided with a metal body 25 having four sides 26, 27, 28 and 29, which taken in pairs are opposite sides, a face 30 for anchoring and a face 31 for attaching to a wall, here to the wall 2 via fastening systems 32 (described later).

The opposite sides 26 and 27, and respectively 28 and 29, of the fastening panel 11 have edges of different complementary shapes which are configured to be able to engage with each other for the assembly together of the plurality of fastening panels 11.

The fastening panels 11 comprise a plurality of recesses 40 formed in the body 25.

These recesses which here are H-shaped, are nested within each other and are present over the whole of the body 25 of the fastening panel 11.

Here, each recess 40 is a through-recess, that is to say that it opens both through the anchoring face 30 and through the attaching face 31.

Each recess 40 has an insertion portion 41 extending in a predetermined direction, here longitudinal, and provided with a first end 42, with a second end 43 which is an opposite end to the first end 42, with an upper edge 44 and with a lower edge 45 which is an opposite edge to the upper edge 44.

Each of the upper and lower edges 44, 45 meets the first and second ends 42, 43.

Each recess 40 is furthermore provided with two upper reception portions 48, 50 projecting orthogonally from the upper edge 44 and facing and being parallel to each other and two lower reception portions 49, 51 projecting orthogonally from the lower edge 45 and facing and being parallel to each other.

The upper and lower reception portions 48, 49 are formed projecting from the first end 42 of the insertion portion 41 of the recess 40; and extend facing each other.

The upper and lower reception portions 50, 51 are formed projecting from the second end 43 of the insertion portion 41 of the recess 40; and extend facing each other.

The fastening panel 11 further comprises a plurality of support blocks 46, 47 formed in the body 25, on account of the recesses 40.

Each support block 46, and respectively 47, is bordered at least in part by the upper edge 44, and respectively by the lower edge 45, and by the two upper reception portions 48, 50, and respectively by the two lower reception portions 49, 51.

It will be noted that the insertion portion 41 has a first predetermined length, the support blocks 46, 47 each have a second predetermined length as well as a first predetermined thickness.

It will furthermore be noted that the longitudinal branch 16 of the fastening interface 15 has a third predetermined length and that the transverse branches 17, 18 have a fourth predetermined length.

The third predetermined length of the longitudinal branch 16 is comprised between said first and second predetermined lengths respectively of the insertion portion 41 and of the support blocks 46, 47.

The fourth predetermined length of the transverse branches 17, 18 is greater than or equal to the first predetermined thickness of the support blocks 46, 47.

The fastening systems 32 are in particular provided with a fixed spacer (not shown) attached to the wall 2 via a screw, with a complementary spacer enabling the fastening panel 10, in particular its attaching face 31, to be kept away from the wall 2 and a second fastening device (not shown) such as a metal screw configured to fasten that fastening panel 11 to the wall 2 via the complementary spacer.

For this, the fastening panel 11 has several apertures (not shown) formed in the body 25 and opening through the anchoring face 30 and through the attaching face 31, for the passage of the fastening screw for fastening that panel 11 to the wall 2.

These apertures are distinct from the recesses 40.

It will be noted that the assembly 5 is furthermore provided with a plurality of obturating plugs 33 each configured to be inserted into such an aperture of the fastening panel 11.

Furthermore, each obturating plug 33 is configured to be mounted flush with the anchoring face 30 of the fastening panel 11.

It will be noted here that the fastening panel 11 is attached to the wall 2 via nine fastening systems 32.

A description will now be given of the steps of the method of assembly of a covering module 6 onto the assembly 5 with reference to FIGS. 4 to 6.

The connection interfaces 15, of which there are four here, are first of all fastened to the back face 12 of the module 6 with screws 24.

Figure 4:
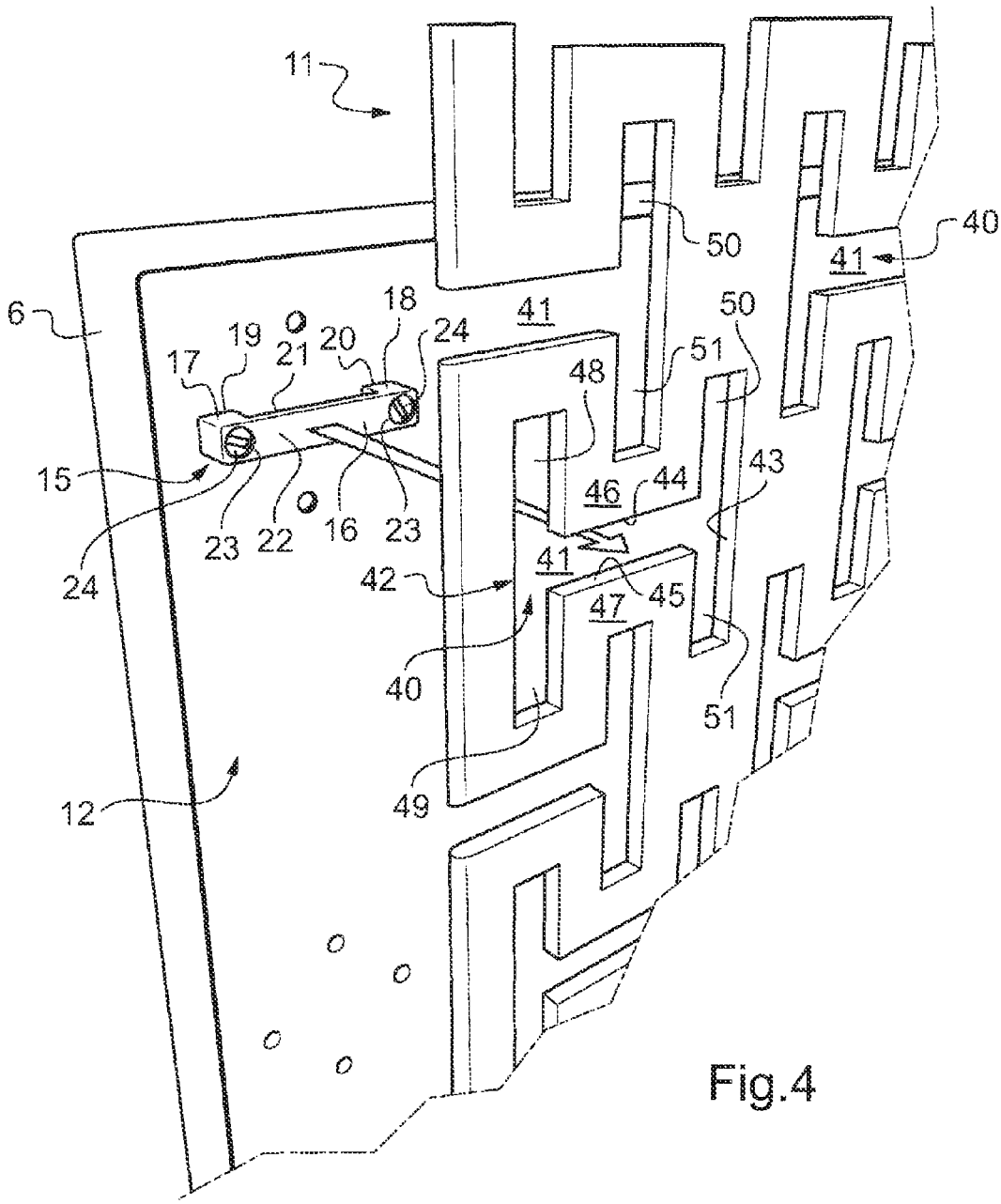
FIGS. 4 to 6 are detail views similar to that of FIG. 3, which show the steps of mounting and attaching the covering element of FIG. 2 onto the fastening structure of the assembly illustrated in FIG. 1.

In FIG. 4, the module 6 is away from the fastening panel 11, the back face 12 of the module 6 facing the anchoring face 30 of the fastening panel 11.

In particular, the longitudinal branch 16 of the fastening interface 15 is disposed facing the insertion portion 41 of the recess 40.

Figure 5:
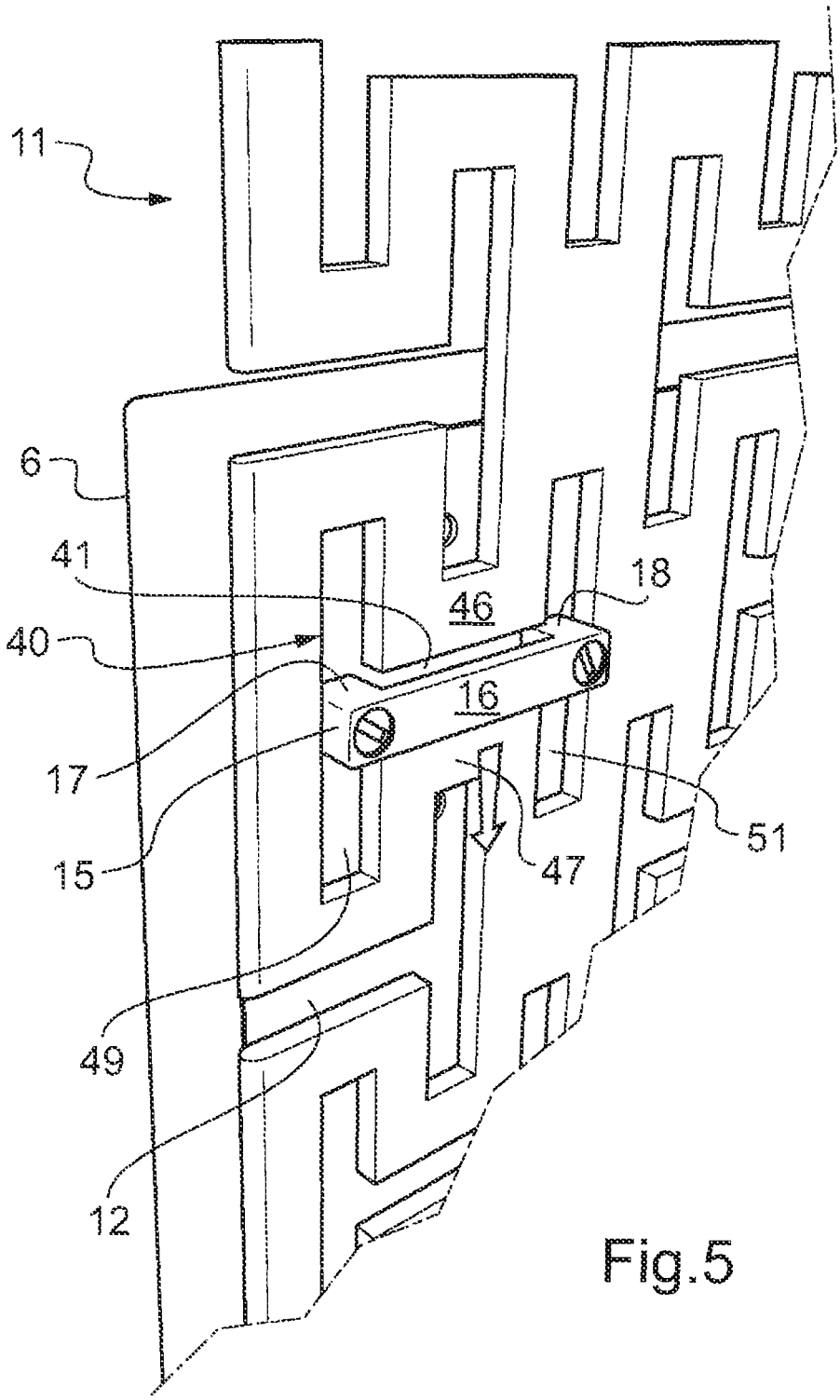

The module 6 is moved towards the fastening panel 11, in the direction of the arrow visible on that FIG. 4, until that longitudinal branch 16 is inserted into the insertion portion 41 (FIG. 5).

The module 6 is sufficiently applied against the fastening panel 11 for the module 6 subsequently to be able to be moved downwards relative to the fastening panel 11, in the direction of the arrow visible in that FIG. 4, the inside bearing face 21 of the longitudinal branch 16 sliding against the opposite face 31 of the body 25 to the anchoring face 30, along the support block 46.

The transverse branches 17 and 18 of the fastening interface 15 are then each received at least partially in the respective lower reception portion 49, 51.

Figure 6:
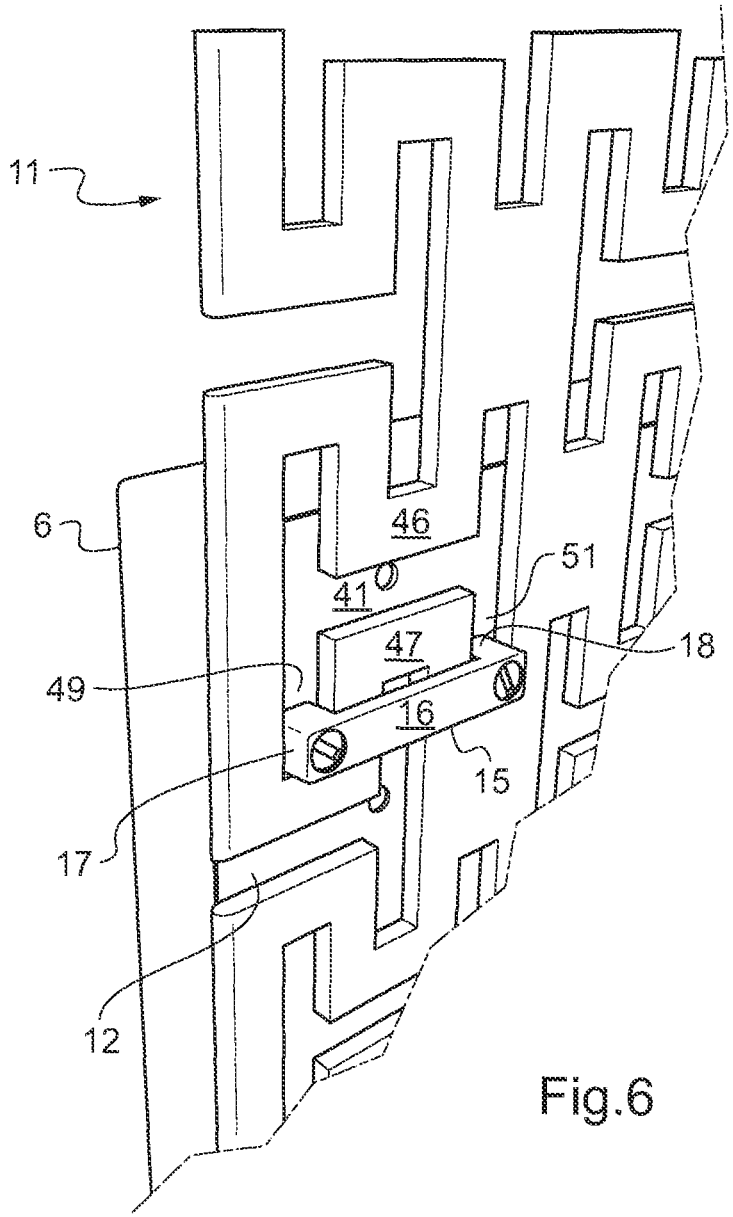

The transverse branches 17 and 18 come to rest at the bottom of the respective lower reception portion 49, 51 (FIG. 6).

The module 6 is thus very simply mounted on the fastening panel 11.

Of course, the removal of this module 6 from the fastening panel 11 is carried out very simply by the reverse steps of those described above.

The assembly 5 provides interior covering modularity that is particularly advantageous since that modularity enables simplicity and convenience both for putting in place and for removal of covering modules 6 while preserving both their structural and aesthetic integrity.

The covering modules are particularly easy to mount on the fastening structure 10, by virtue of the fastening interfaces 15, the recesses 40 and the support blocks 46 and 47 of the fastening panels 11.

It is to be noted here that the fastening interfaces 15 attached to the modules 6 are engaged on the support blocks 46, but that if the fastening panels 11 were to be turned round, through 180°, the fastening interfaces 15 would then be engaged on the support blocks 47 without the slightest difficulty.

Figure 7:
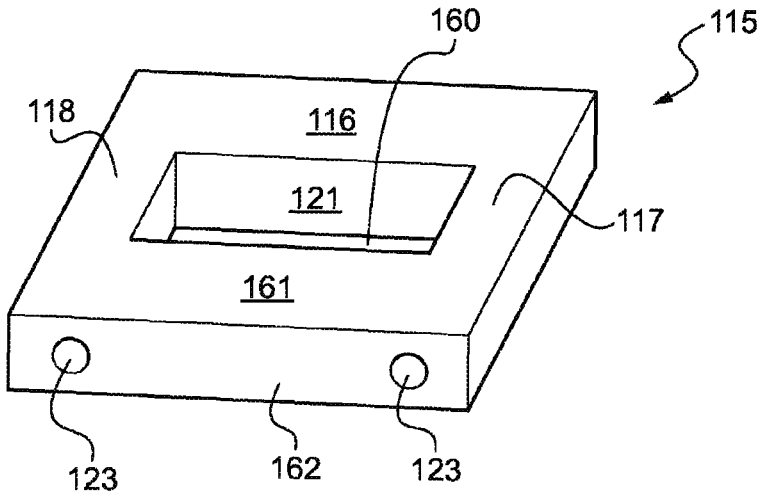
FIG. 7 is a perspective view of a variant of the fastening interface visible in FIGS. 2 to 6.

FIG. 7 illustrates a variant embodiment of the fastening interface 15 visible in FIGS. 2 to 6.

Generally, for similar parts the same references have been used, to which the number 100 has been added.

In contrast to the fastening interface 15, the fastening interface 115 is ring-shaped.

In other words, the fastening interface 115 has another longitudinal branch 161, also called fourth branch, which meets the transverse branches 117 and 118 and which faces the first longitudinal branch 116.

An internal space 160 is thus created between the four branches 116, 117, 118 and 161.

The holes 123 pass through each of the two longitudinal branches 116 and 161 and one respective transverse branch 117, 118.

The connection interface 115 is configured to come to bear against the bottom face of the module via an outside face 162 of the fourth branch 161 and that connection interface always comes to bear on a support block of the fastening panel via the inside bearing face 121 of the first branch 116.

The steps of putting in place and removal of the covering modules 6 on the fastening structure 10 via that fastening interface 115 are identical to that which was described earlier for the fastening interface 15.

Figure 8:
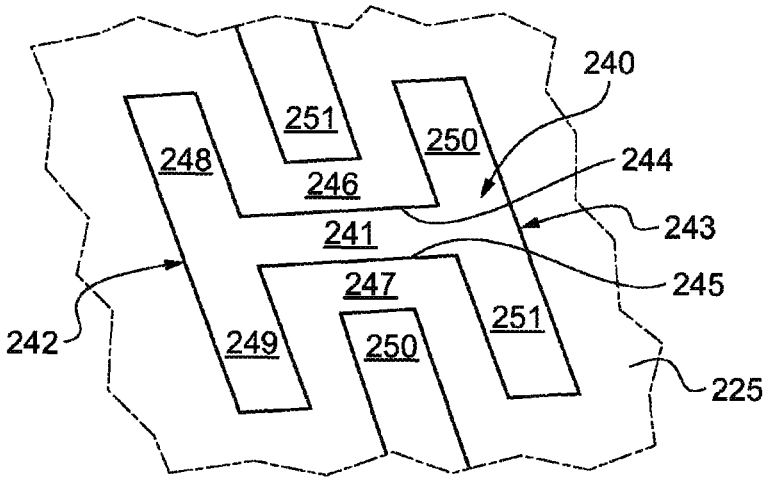
FIGS. 8 and 9 are detail views, in plan, respectively of a first variant and of a second variant of the fastening structure visible in FIGS. 1 and 3 to 6.

FIG. 8 illustrates a first variant embodiment of the recesses 40 visible in FIGS. 1 and 3 to 6.

Generally, for similar parts the same references have been used, to which the number 200 has been added.

In contrast to the recesses 40, the recesses 240 have upper and lower portions 248, 249, 250 and 251 which project from the insertion portion 241 at the first and second ends 242 and 243, and which face each other, but inclined non-orthogonally relative to the upper and lower edges 244 and 245.

Furthermore, the support blocks 246 and 247 so defined thus have a shape which is also inclined non-orthogonally where they are bordered by the upper and lower portions 248, 249, 250 and 251.

Figure 9:
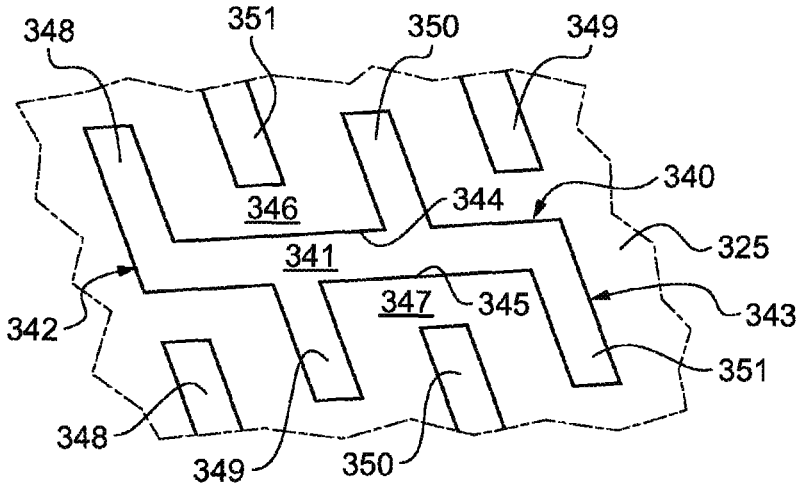

FIG. 9 illustrates a second variant embodiment of the recesses 40 visible in FIGS. 1 and 3 to 6.

Generally, for similar parts the same references have been used, to which the number 300 has been added.

In contrast to the recesses 40, the recesses 340 have upper and lower portions 348, 349, 350 and 351 which project from the insertion portion 241 facing each other, but, like the recesses 240, inclined non-orthogonally relative to the upper and lower edges 344 and 345.

Furthermore, the support blocks 346 and 347 so defined thus have a shape which is also inclined non-orthogonally where they are bordered by the upper and lower portions 348, 349, 350 and 351.

It will furthermore be noted that in contrast to the recesses 40 and 240, only the upper 348 and lower 351 portions extend at the location of the first and second ends 342 and 343.

As for the upper 350 and lower 349 portions, these extend respectively along the upper 344 and lower 345 edges, between the first and second ends 342 and 343.

In variants that are not illustrated:

- the fastening structure and/or the fastening interface are not formed from metal, and respectively from plastic, but more generally from rigid and/or semi-rigid material;
- the covering is different from leather and/or a textile, but is instead produced from wood or from metal or from cardboard or from plastic or from stone;
- the assembly is not configured for the interior wall covering of a home, but instead for objects, for example a bed headboard, or for an exterior wall of a home or more generally of a building;
- the fastening interfaces are not attached to a single covering module, but rather to two covering modules;
- the fastening interfaces are not attached to a single fastening panel, but rather to two fastening panels;
- the fastening structure is not attached to an interior wall, but the fastening structure is rather disposed on a carrier member for example placed on the floor; and/or
- the kit is not only provided with covering modules, but it is furthermore provided with functional modules such as wall lamp modules or multimedia modules.

It should be noted more generally that the invention is not limited to the examples described and represented.

The invention claimed is:

1. An assembly for wall covering, characterized in that the assembly comprises a fastening structure (10) and a fastening interface (15; 115) configured to be joined to at least one covering element (6) and to be mounted on said fastening structure (10), said fastening structure (10) being provided with a body (25; 225; 325), with at least one anchoring face (30) and with at least one recess (40; 240; 340) formed in said body (25; 225; 325) and opening onto said anchoring face (30), said at least one recess (40; 240; 340) comprising an insertion portion (41; 241; 341) which extends in a predetermined direction and which is provided with a first end (42; 242; 342), a second end (43; 243; 343) opposite said first end (42; 242; 342), an upper edge (44; 244; 344) and lower edge (45; 245; 345) opposite said upper edge (44; 244; 344), each of said upper (44; 244; 344) and lower edges (45; 245; 345) meeting said first (42; 242; 342) and second ends (43; 243; 343), two spaced apart, parallel upper reception portions (48, 50; 248, 250; 348, 350) extending from said upper edge (44; 244; 344) in a first direction and two spaced apart, parallel lower reception portions (49, 51; 249, 251; 349, 351) extending from said lower edge (45; 245; 345) in a second direction opposite said first direction; said fastening structure (10) being furthermore provided with at least two support blocks (46, 47; 246, 247; 346, 347) formed in said body (25; 225; 325) and each bordered at least partly by one of said upper (44; 244; 344) and lower (45; 245; 345) edges and by the two said upper (48, 50; 248, 250; 348, 350) or lower (49, 51; 249, 251; 349, 351) reception portions; said fastening interface (15; 115) being provided with a first branch (16; 116), a second branch (17; 117) and a third branch (18; 118), said second branch (17; 117) and said third branch (18; 118) projecting from said first branch (16; 116) parallel to one another in a same direction; said first branch (16; 116) being configured to be inserted into said insertion portion (41; 241; 341) then slid against a second face (31) of said body (25; 225; 325), wherein said second face is opposite said anchoring face (30), along a said support block (46, 47; 246, 247; 346, 347); said second (17; 117) and third (18; 118) branches being configured to be received at least partially in the two said upper (48, 50; 248, 250; 348, 350) or lower (49, 51; 249, 251; 349, 351) reception portions.

2. An assembly according to claim 1, characterized in that at least two of said upper (48, 50; 248, 250; 348, 350) and lower (49, 51; 249, 251; 349, 351) reception portions are projecting from said upper edge (44; 244; 344), and lower edge (45; 245; 345), respectively, at the location of one of said first (42; 242; 342) and second (43; 243; 343) ends of said insertion portion (41; 241).

3. An assembly according to claim 2, characterized in that each of the two said upper reception portions (48, 50; 248, 250) are facing one of the two said lower reception portions (49, 51; 249, 251).

4. An assembly according to claim 1, characterized in that each of the two said upper reception portions (48, 50; 248, 250) are facing one of the two said lower reception portions (49, 51; 249, 251).

5. An assembly according to claim 1, characterized in that said first and second directions are orthogonal to said predetermined direction in which said insertion portion (41; 241; 341) extends.

6. An assembly according to claim 1, characterized in that said at least one recess (40; 240) is substantially H-shaped.

7. An assembly according to claim 1, characterized in that said fastening structure (10) has a plurality of said recesses (40; 240; 340) nesting with each other and formed over a major part of said fastening structure (10).

8. An assembly according to claim 1, characterized in that said insertion portion (41; 241; 341) has a first predetermined length, said at least two support blocks (46, 47; 246, 247; 346, 347) each have a second predetermined length as well as a first predetermined thickness, said first branch (16; 116) has a third predetermined length comprised between said first and second predetermined lengths; and said second (17; 117) and third (18; 118) branches have a fourth predetermined length greater than or equal to said first predetermined thickness.

9. An assembly according to claim 1, characterized in that said fastening interface (115) has a fourth branch (161) meeting said second (117) and third (118) branches and facing said first branch (116), so as to be ring-shaped.

10. An assembly according to claim 1, characterized in that said fastening interface (15; 115) has at least one through-hole (23; 123) formed through said first branch (16; 116) and one of said second (17; 117) and third (18; 118) branches, which hole (23; 123) is configured to receive a first device (24) for attaching said fastening interface (15; 115) to a said covering element (6).

11. An assembly according to claim 1, characterized in that said fastening structure (10) is provided with at least one through-aperture distinct from said at least one recess (40; 140; 240) and configured to receive a second device (32) for attaching said fastening structure (10) to a wall (2).

12. An assembly according to claim 11, characterized in that the assembly comprises a plug (33) for obturating said through-aperture of said fastening structure (10) for attaching the fastening structure to a said wall (2), which obturating plug (33) is configured to be mounted flush with said anchoring face (30).

13. An assembly according to claim 1, characterized in that said fastening structure (10) and said fastening interface (15; 115) are formed from rigid or semi-rigid material.

14. An assembly according to claim 13, characterized in that said fastening structure (10) is of metal and said fastening interface (15; 115) is of plastics material.

15. An assembly according to claim 1, characterized in that said fastening structure (10) is provided with a plurality of panels (11) assembled to each other and with a plurality of said fastening interfaces (15; 115) mounted on each of said panels (11).

16. A kit comprising the assembly (5) according to claim 1 and a plurality of covering elements configured to be mounted on said assembly (5).

* * * * *